US010368158B2

(12) United States Patent
Hsiao et al.

(10) Patent No.: US 10,368,158 B2
(45) Date of Patent: Jul. 30, 2019

(54) EARPHONE DEVICE THAT SWITCHED TO AN OPEN-TYPE OR A CLOSED-TYPE EARPHONE DEVICE

(71) Applicant: COOLER MASTER TECHNOLOGY INC., New Taipei (TW)

(72) Inventors: Shih-Hsiung Hsiao, New Taipei (TW); Shau-Jiun Huang, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 0 days.

(21) Appl. No.: 15/391,161

(22) Filed: Dec. 27, 2016

(65) Prior Publication Data

US 2017/0195780 A1 Jul. 6, 2017

(30) Foreign Application Priority Data

Dec. 30, 2015 (CN) ..... 2015 1 1020460
Mar. 14, 2016 (CN) ..... 2016 1 0142838

(51) Int. Cl.
*H04R 1/28* (2006.01)
*H04R 1/10* (2006.01)

(52) U.S. Cl.
CPC ..... *H04R 1/2803* (2013.01); *H04R 1/1008* (2013.01); *H04R 1/1041* (2013.01); *H04R 1/1058* (2013.01)

(58) Field of Classification Search
CPC .. H04R 1/1008; H04R 1/1041; H04R 1/1025; H04R 1/1066; H04R 1/1058; H04R 1/2869; H04R 1/2807; H04R 1/2803; H04R 1/2834; H04R 1/1083
See application file for complete search history.

(56) References Cited

U.S. PATENT DOCUMENTS 7,292,704 B2 * 11/2007 Lederer ..... G01R 33/283 381/380
9,736,563 B1 * 8/2017 Glass ..... H04R 1/1008
2008/0152180 A1 * 6/2008 Tsai ..... H04R 1/2834 381/338
2010/0128885 A1 * 5/2010 Roos ..... H04R 1/1083 381/72
2013/0142376 A1 * 6/2013 Lin ..... H04R 1/1008 381/373
2013/0272560 A1 * 10/2013 Dougherty ..... H04R 1/1066 381/378

(Continued)

FOREIGN PATENT DOCUMENTS

CN 104754440 A 7/2015
DE 202005003656 * 7/2005

(Continued)

*Primary Examiner* — Fan S Tsang
*Assistant Examiner* — Angelica M McKinney
(74) *Attorney, Agent, or Firm* — Maschoff Brennan

(57) ABSTRACT

An earphone device comprises a casing, an earphone body and a switching unit. The casing includes an opening and an accommodating space, and the opening communicates with the accommodating space and an outside of the casing. The earphone body is disposed in the accommodating space. The switching unit is disposed on the casing. The switching unit can selectively seal or expose the opening to correspondingly switch the earphone device to an open-type earphone device or a closed-type earphone device.

5 Claims, 10 Drawing Sheets

(56) References Cited

U.S. PATENT DOCUMENTS

| | | | | |
|---|---|---|---|---|
| 2013/0294633 | A1* | 11/2013 | Steyn | H04R 1/1025<br>381/370 |
| 2014/0376765 | A1* | 12/2014 | Toelle | H04R 1/1058<br>381/384 |
| 2015/0222980 | A1* | 8/2015 | Pizzaro | H04R 1/1058<br>381/371 |

FOREIGN PATENT DOCUMENTS

| | | |
|---|---|---|
| TW | 280065 | 7/1996 |
| TW | I261476 | 9/2006 |
| TW | M433042 | 7/2012 |
| TW | M462193 U | 9/2013 |
| TW | M480225 U | 6/2014 |
| TW | I457009 | 10/2014 |

* cited by examiner

EARPHONE DEVICE THAT SWITCHED TO AN OPEN-TYPE OR A CLOSED-TYPE EARPHONE DEVICE

CROSS REFERENCE TO RELATED APPLICATIONS

This Non-provisional application claims priority under 35 U.S.C. § 119(a) on Patent Application No(s). 201511020460.1 and 201610142838.3 filed in People's Republic of China on Dec. 30, 2015 and Mar. 14, 2016, the entire contents of which are hereby incorporated by reference.

BACKGROUND OF THE INVENTION

Field of Invention

This invention relates to an earphone device and, in particular, to an earphone device having a resonant chamber with an adjustable volume.

Related Art

In general, an earphone device includes an open type and a closed type, both of which have their respective fans. Besides, these two types can bring different hearing experiences for users. The open-type earphone device is better at middle-high frequency performance and can bring more exquisite performance of audio frequency output especially in listening to classical symphonic music. On the other hand, in comparison with the open-type earphone device, the closed-type earphone device is better at low frequency performance and can obviously perform well especially in listening to the more powerful audio content such as drumbeat, strong-rhythm dance music, gun shot, explosion sound or special effect sound.

Therefore, regardless of the performance on audio frequency or the musical type, an obvious difference exists between the open-type earphone and the closed-type earphone. Besides, when a user likes to listen to various musical types, such as symphonic music and strong-rhythm dance music, the user needs to buy these two types of earphone devices since one of the two types can not possess the advantage of the other type. Moreover, one of these two types of the earphone devices is only for the particular type of music, so that the user can not have better hearing experience.

SUMMARY OF THE INVENTION

An objective of the invention is to provide an earphone device, which can be, in comparison with a single type of earphone device of the prior art, selectively switched to an open-type earphone device or a closed-type earphone device based on the user's requirement, so as to give the user different hearing experiences.

In an embodiment, an earphone device comprises a casing, an earphone body and a switching unit. The casing includes an opening and an accommodating space, and the opening communicates with the accommodating space and an outside of the casing. The earphone body is disposed in the accommodating space. The switching unit is disposed on the casing. The switching unit can selectively seal or expose the opening to correspondingly switch the earphone device to an open-type earphone device or a closed-type earphone device.

In an embodiment, an earphone device comprises a casing, an earphone body and an adjustment unit. The casing includes a resonant chamber. The earphone body is disposed in the resonant chamber. The adjustment unit adjusts a volume of the resonant chamber to selectively make an audio frequency characteristic of the earphone device approximate to an open-type earphone device or a closed-type earphone device.

In an embodiment, an earphone device comprises a casing, an earphone body, a drivable member and a rotation member. The casing includes a resonant chamber. The earphone body is disposed in the resonant chamber. The drivable member is disposed at the casing and connected with the resonant chamber. The rotation member is disposed at the casing. When the rotation member is rotated, the drivable member is driven to adjust a volume of the resonant chamber to selectively make an audio frequency characteristic of the earphone device approximate to the open-type earphone device or the closed-type earphone device.

In one embodiment, the earphone body includes a resonant film, which faces the opening.

In one embodiment, the switching unit includes a cover and a magnetic member disposed on the cover to make the cover and the casing attract each other to cover the opening.

In one embodiment, the earphone device further comprises a sealing member embedded into between the cover and the casing.

In one embodiment, the switching unit comprises a cover and a protruding portion connected with the cover. The casing further includes an indented portion, the indented portion is disposed on an edge of the opening and corresponding to the protruding portion, and the cover covers the opening when the protruding portion is embedded into the indented portion.

In one embodiment, the switching unit further includes a connecting member, and the cover is connected with the casing through the connecting member when the cover does not cover the opening.

In one embodiment, a groove is disposed at a periphery of the casing, a plurality of through holes are disposed on the groove to make an inside and an outside of the earphone body communicate with each other, and the switching unit includes a protruding bar embedded into the groove to seal the through holes.

In one embodiment, a plurality of through holes are disposed outside the earphone body to make an inside and an outside of the earphone body communicate with each other, and the switching unit includes a plurality of protruding pillars respectively sealing the through holes.

In one embodiment, when the adjustment unit increases the volume of the resonant chamber, the audio frequency characteristic of the earphone device more approximates to the closed-type earphone device, and when the adjustment unit decreases the volume of the resonant chamber, the audio frequency characteristic of the earphone device more approximates to the open-type earphone device In one embodiment, when the drivable member enters the resonant chamber, the audio frequency characteristic of the earphone device approximates to the open-type earphone device, and when the drivable member leaves the resonant chamber, the audio frequency characteristic of the earphone device approximates to the closed-type earphone device.

As mentioned above, in an earphone device of the invention, by the switching unit capable of selectively sealing or exposing the opening, the earphone device can be correspondingly switched to the open-type earphone device or the closed-type earphone device. Or, by the adjustment unit adjusting the volume of the resonant chamber, the audio frequency characteristic of the earphone device can be selectively made approximate to the open-type earphone device or the closed-type earphone device. Or, by the rotation member rotating to drive the drivable member to adjust the volume of the resonant chamber, the audio frequency characteristic of the earphone device can be selectively made approximate to the open-type earphone device or the closed-type earphone device. Therefore, in comparison with a single type of earphone device of the prior art, the earphone device of the invention can possess the both advantages of the open-type and the closed-type earphone devices so that the user can have different hearing experiences when listening to different types of music.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

With reference to the related figures, the devices of the embodiments of the invention are illustrated, wherein the same component is given the same reference sing for the illustration. The figures of all the embodiments of the invention are just for the illustration but not for showing real dimension and size ratio. Besides, the orientation terms such as "above", "below", "up" and "down" mentioned in the embodiments are just for showing the relative position relationship. Moreover, when a component is formed on, above, below or under another component, this at least means that the component directly contacts the another component, or that a further component is disposed between the component and the another component so that the component does not directly contact the another component.

Figure 1A:
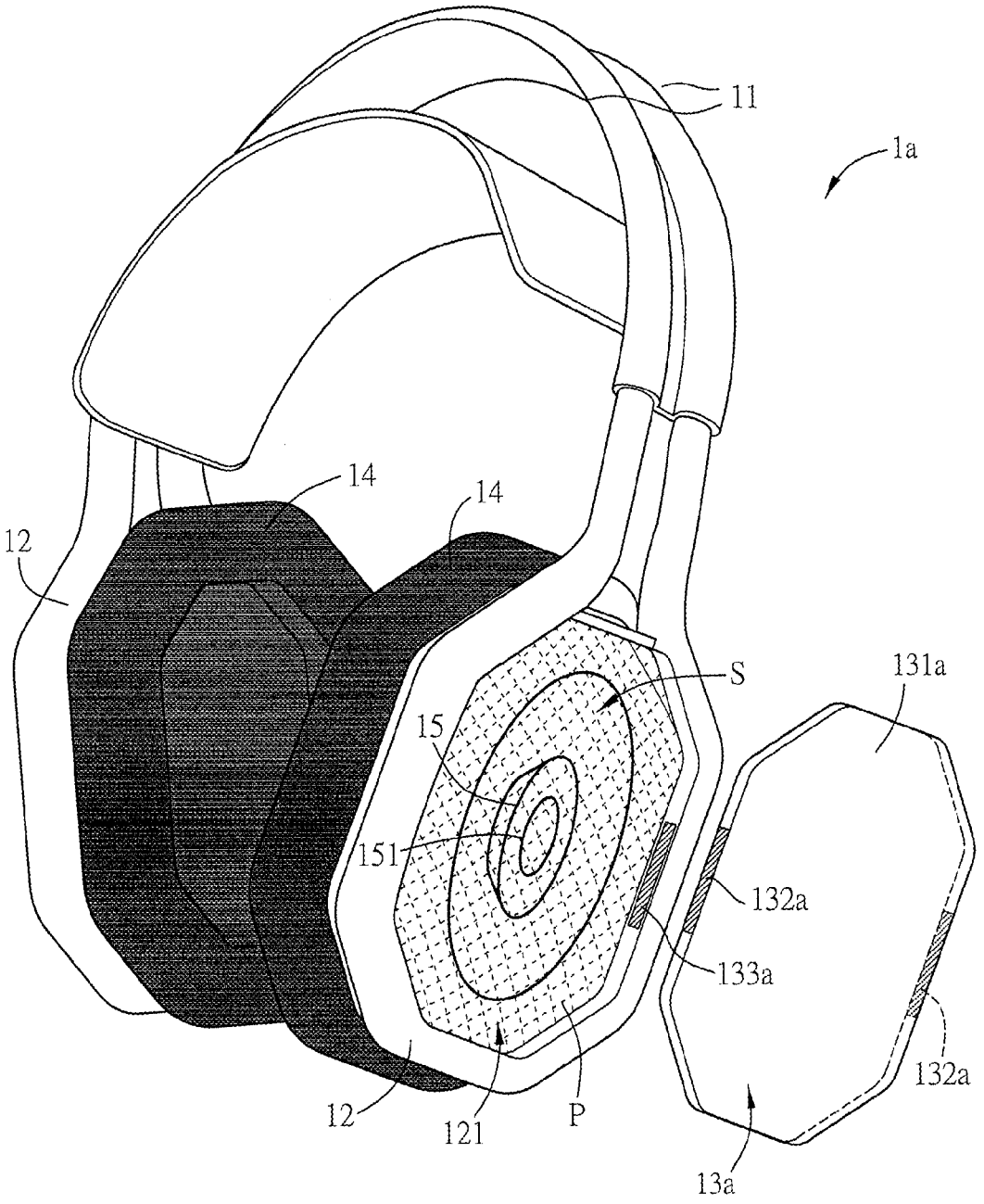
FIG. 1A is a schematic diagram of an earphone device of an embodiment of the invention.

Please refer to FIG. 1A, which is a schematic diagram of an earphone device 1*a* of an embodiment of the invention.

The earphone device 1*a* includes a casing 12, a switching unit 13*a* and an earphone body 15. Moreover, the earphone device 1*a* of this embodiment further include a head band 11. Each of two sides of the head band 11 is connected with a casing 12, and each of the casings 12 is connected with an ear pad 14. The material of the casing 12 can be plastic material, metal, alloy or wood material, or their any combination, and this invention is not limited thereto.

The casing 12 includes an opening 121 and an accommodating space S. The size of the accommodating space S is in relation to the earphone body 15. If the earphone body 15 has greater output power, a larger accommodating space S is required; on the contrary, if the earphone body 15 has less output power, a smaller accommodating space S is generally required. Therefore, the accommodating space S can be adjusted based on the function and purpose of the earphone device. Moreover, the opening 121 can be configured with a protection structure P, which is disposed for protecting the earphone body 15 disposed within the accommodating space S from being damaged due to the exposure to outside, and the earphone device 1*a* is thus made more durable. The material of the protection structure P is, for example but not limited to, metal mesh, sponge or polymer material.

The earphone body 15 includes a resonant film 151. The material of the resonant film 151 also can be changed based on the function or purpose of the earphone device. The disposition direction of the resonant film 151 faces the direction of the opening 121, i.e. the outside direction of the earphone device 1*a*. Because the resonant film 151 does not face the ear of a user, the user will not be subject to the impaired hearing when using the earphone device 1*a* for a long period of time.

The switching unit 13*a* is disposed at the casing 12, and the opening 121 of the casing 12 can be selectively sealed or exposed by the switching unit 13*a*. When the opening 121 is exposed, the earphone body 15 is exposed from the casing 12 (which means the earphone body can be seen from outside). In this situation, the earphone device 1*a* is the open-type earphone, which is better at middle-high frequency performance and can bring more exquisite performance of audio frequency output especially in listening to human sound or classical symphonic music. Besides, because there is no separation between the earphone body 15 and the outside, the user will not easily feel oppression when listening to the music.

Moreover, when the switching unit 13*a* seals the opening 121 of the casing 12, the earphone body 15 will also be covered. In other words, the earphone body 15 can not be seen from the outside of the casing 12. In this situation, the earphone device 1*a* becomes the closed-type earphone device, which, in comparison with the open-type earphone, is better at low frequency performance and obviously performs very well especially in listening to the more powerful audio content such as drumbeat, or strong-rhythm dance music, or gun shot, explosion sound and special effect sound in a movie or computer game. Besides, because the earphone body 15 of the closed-type earphone is separated from the outside environment, the sound emitted out of the earphone device will not affect other people, and the user will also not be affected by the outside noise so as to achieve the purpose of the passive-type noise reduction.

In this embodiment, as shown in FIG. 1A, the switching unit 13*a* of the earphone device 1*a* includes a cover 131*a* and a magnetic member 132*a*, and the magnetic member 132*a* is disposed on the cover 131*a* so that the cover 131*a* can be attracted by the casing 12 to cover the opening 121. Herein, there are two magnetic members 132*a* and they are embedded into two sides of the cover 131*a*. Moreover, the cover 131*a* is embedded into the opening 121 to cover the opening 121. The casing 12 of this embodiment is made of non-metal material (e.g. plastic material). Accordingly, two edges of the opening 121 of the casing 12 are configured with two magnetic members 133*a* which are disposed corresponding to the two magnetic members 132*a* of the cover

131*a*, and the magnetic members 132*a* and 133*a* match each other so that the cover 131*a* and the casing 12 can be attracted by each other to cover the opening 121. To be noted, the magnetic attraction between the magnetic members 132*a* and 133*a* can not be too strong or too weak. When the magnetic attraction between the magnetic members 132*a* and 133*a* is too strong, the audio output performance of the earphone body 15 in the accommodating space S will be affected and the user will not easily separate the cover 131*a* and the casing 12 from each other. More seriously, the sound of the earphone body 15 may be not outputted. On the other hand, if the magnetic attraction between the magnetic members 132*a* and 133*a* is too weak, the cover 131*a* will not securely and completely cover the opening 121 and the earphone device 1*a* can not be accurately switched between the open type and the closed type. In different embodiments wherein the casing 12 is made of metal material such as iron, steel or nickel, the magnetic members 132*a* disposed on the edges of the cover 131*a* can directly attract the casing 12 so that the cover 131*a* can cover the opening 121. In this case, it is not required to dispose the magnetic members 133*a* on the edges of the opening 121.

Moreover, in order to solve the problem that the cover 131*a* can not completely seal the opening 121, the earphone device 1*a* can further include a sealing member (not shown). The material of the sealing member can be, for example, sponge, rubber or soft buffering material, and the sealing member can be embedded into the gap between the cover 131*a* and the casing 12. By the disposition of the sealing member, the cover 131*a* can be made securely and completely seal the opening 121. In short, when the switching unit 13*a* is selectively used to seal the opening 121, the audio frequency performance of the closed-type earphone device will be affected due to the air leakage or sound leakage occurring between the cover 131*a* and the opening 121. Therefore, the sealing member can solve this problem and make the audio frequency performance of the closed-type earphone device better.

Figure 1B:
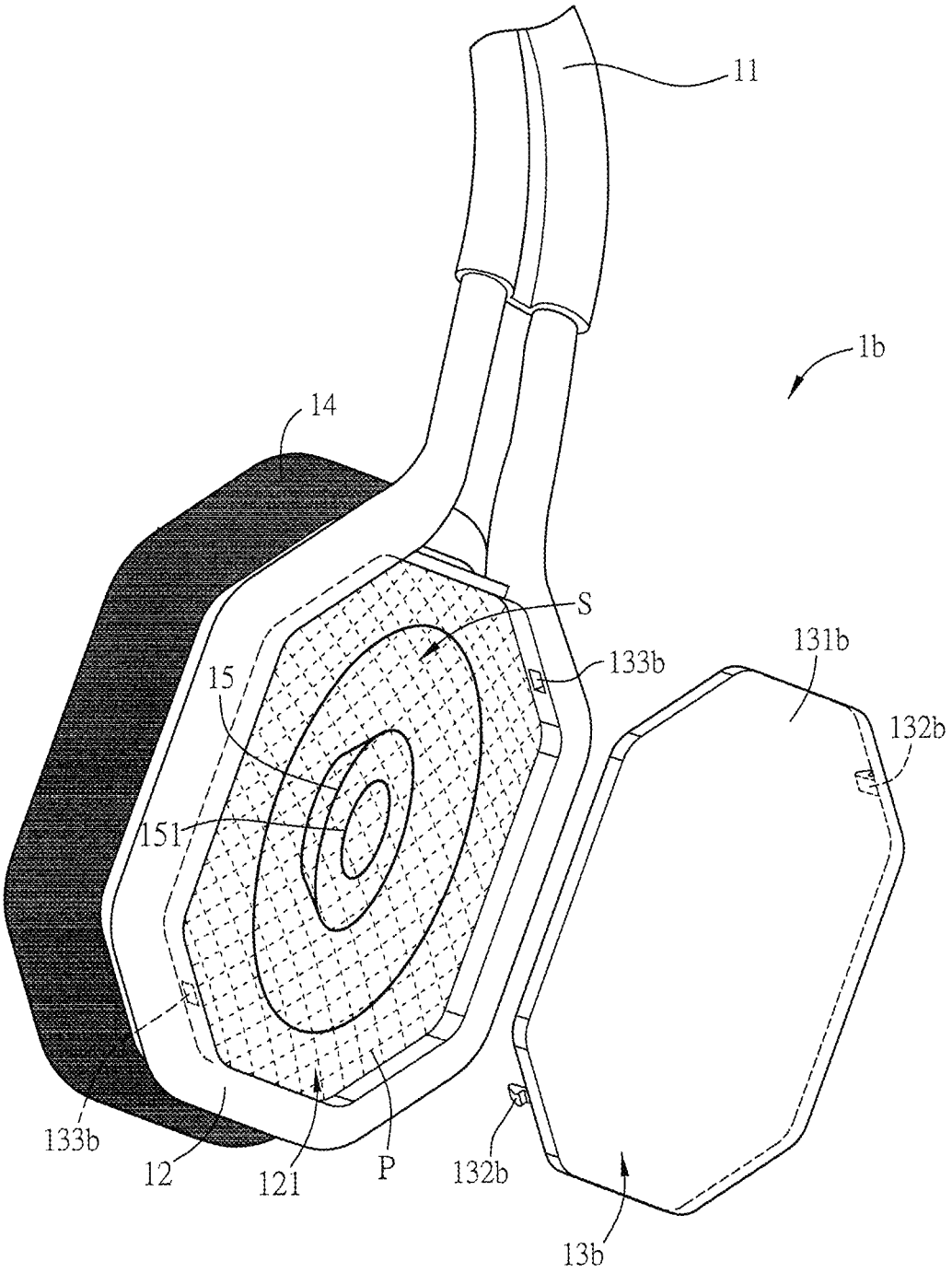
FIGS. 1B and 1C are schematic diagrams of the earphone devices of different embodiments of the invention.
Figure 1C:
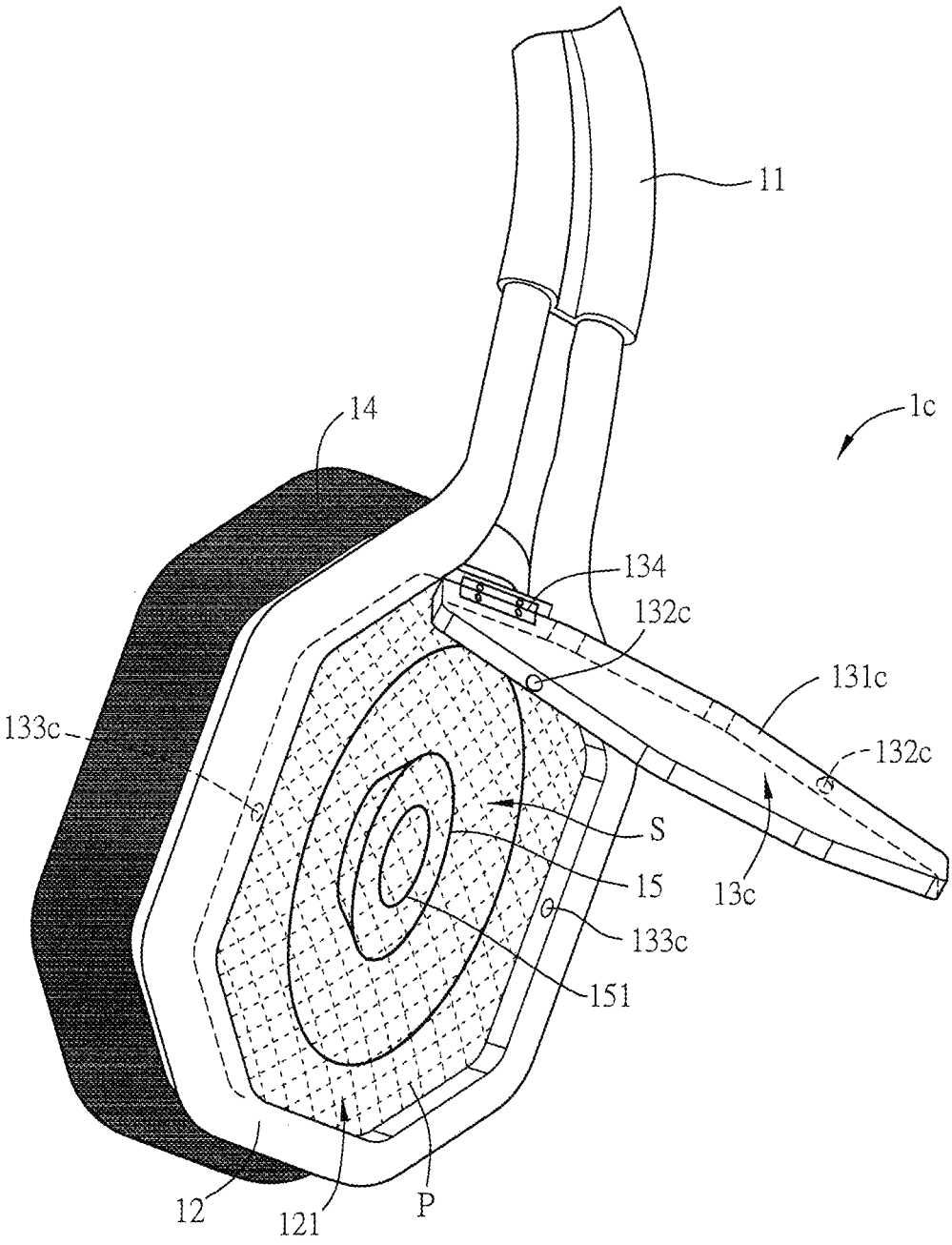

Please refer to FIGS. 1B and 1C, which are schematic diagrams of the earphone devices 1*b* and 1*c* of different embodiments of the invention.

As shown in FIG. 1B, the components and structure of the earphone device 1*b* are mostly the same as the earphone device 1*a*. The main difference between the earphone devices 1*b* and 1*a* is in that the switching unit 13*b* of the earphone device 1*b* includes a cover 131*b* and a protruding portion 132*b*. In this embodiment, the switching unit 13*b*, as an example, includes two protruding portions 132*b*, and the protruding portions 132*b* are hooks and disposed on two sides of the cover 131*b*, respectively. Besides, the casing 12 further includes two indented portions 133*b*, which are troughs and disposed on two edges of the opening 121 and corresponding to the two protruding portions 132*b*, respectively. In other embodiments, the number of the protruding portions 132*b* and the corresponding indented portions 133*b* can be changed, as long as they can be disposed to make the cover 131*b* securely cover the opening 121.

As shown in FIG. 1C, the components and structure of the earphone device 1*c* are mostly the same as the earphone device 1*b*. The main difference between the earphone devices 1*c* and 1*b* is in that the switching unit 13*c* of the earphone device 1*c* further includes a connecting member 134. When the cover 131*c* does not cover the opening 121 (which means the cover 131*c* and the casing 12 are separated from each other), the cover 131*c* can be connected with the casing 12 through the connecting member 134 so as to avoid the loss of the cover 131*c*. Moreover, the protruding portion 132*c* of this embodiment is a protruding point and the indented portion 133*c* is a pit. Accordingly, when the protruding portion 132*c* is pulled out of the indented portion 133*c*, the opening 121 can be exposed to the outside and the cover 131*c* and the casing 12 are connected with each other through the connecting member 134. By the design of the connecting member 134, when the user switches the earphone device 1*c* to the open-type earphone, the cover 131*c* is still connected with the casing 12 through the connecting member 134 so as to avoid the loss of the cover 131*c*.

Other technical features of the earphone devices 1*b*, 1*c* can be comprehended by referring to the same components of the earphone device 1*a*, so the related illustration is omitted here for conciseness.

To be noted, in another embodiment, in addition to the above-mentioned connecting member, the switching unit can further include a push member. When the user presses the cover configured with the push member at the first time, the cover can cover the opening, and when the user presses the cover at the second time, one end of the cover configured with the push member will spring and separate from the opening while the other end of the cover is still connected with the casing through the connecting member. Therefore, by the design of the connecting member in combination with the push member, it will be more convenient for the user to use the switching unit in switching between the open-type earphone device and the closed-type earphone device. Besides, because the cover is still connected with the casing through the connecting member, the problem of losing the cover also can be avoided.

Figure 2A:
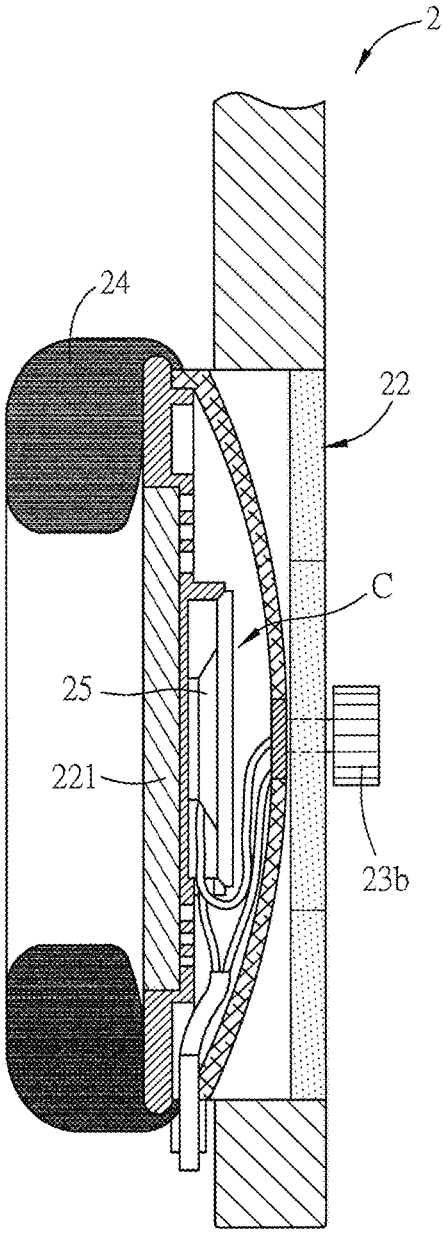
FIGS. 2A and 2B are schematic sectional diagrams of the earphone device of an embodiment of the invention.
Figure 2B:
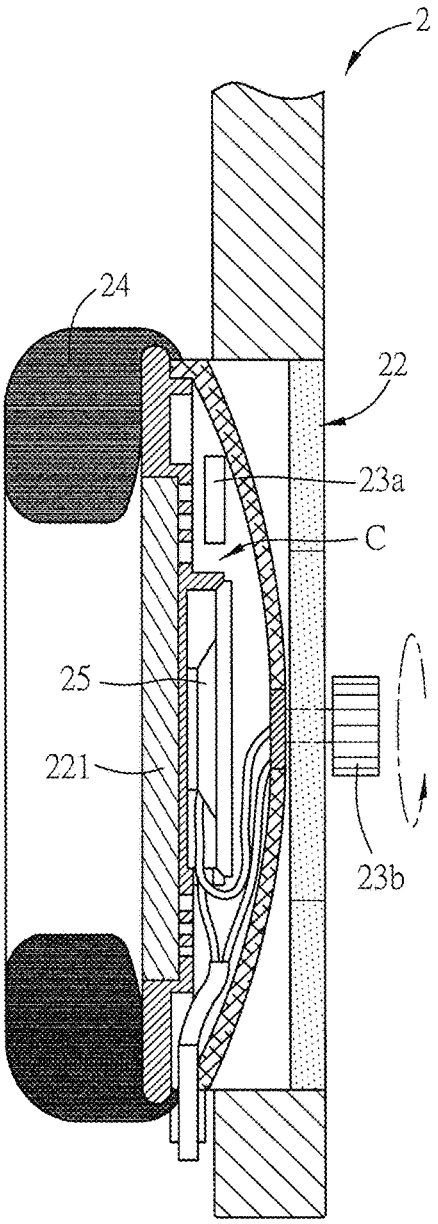

Please refer to FIGS. 2A and 2B, which are schematic sectional diagrams of the earphone device 2 of another embodiment of the invention.

In this embodiment, the earphone device 2 includes a casing 22, a drivable member 23*a* (shown in FIG. 2B), a rotation member 23*b* and an earphone body 25. The material of the casing 22 can be plastic material, metal, alloy or wood material or their any combination.

The casing 22 includes a resonant chamber C therein. The casing 22 of this embodiment further includes a carrier board 221, and the earphone body 25 is disposed on the carrier board 221. Herein, the earphone body 25 is disposed within the casing 22, so that the space containing the earphone body 25 forms the resonant chamber C.

The drivable member 23*a* is disposed within the casing 22 and connected with the resonant chamber C, and the rotation member 23*b* is disposed on the casing 22. FIG. 2A schematically shows the state of that the rotation member 23*b* is not rotated yet. When the rotation member 23*b* is not rotated, the drivable member 23*a* will not appear in the resonant chamber C. At this time, the drivable member 23*a* is hidden inside the casing 22.

Then, as shown in FIG. 2B, when the rotation member 23*b* is rotated, for example, in a clockwise direction, the rotation member 23*b* can cause the drivable member 23*a* to enter the resonant chamber C. When the drivable member 23*a* enters the resonant chamber C, the volume of the resonant chamber C can be reduced, and meanwhile, the performance of the audio frequency characteristic of the earphone device 2 can approximate to the open-type earphone. The open-type earphone is better at middle-high frequency performance and can bring more exquisite performance of audio frequency output especially in listening to human sound or classical symphonic music.

Moreover, when the rotation member 23*b* is rotated in a counterclockwise direction, the rotation member 23*b* also causes the drivable member 23*a* to leave the resonant chamber C so that the volume of the resonant chamber C can be increased. At this time, the drivable member 23*a* is hidden in the casing 22. Because the volume of the resonant chamber C is increased, the performance of the audio frequency characteristic of the earphone device 2 can approximate to the closed-type earphone. In comparison with the open-type earphone, the closed-type earphone is better at low frequency performance and obviously performs very well especially in listening to more shocking audio content such as drumbeat, or strong-rhythm dance music, or gun shot, explosion sound and special effect sound in a movie or computer game.

Therefore, by the drivable member 23*a* in cooperation with the rotation member 23*b*, the drivable member 23*a* can enter or leave the resonant chamber C to cause the increase or decrease of the volume of the resonant chamber C. Thereby, the audio frequency characteristic of the earphone device 2 can be selectively made approximate to the open-type earphone or the closed-type earphone. This embodiment gives an example as the rotation member 23*b* drives the drivable member 23*a*. In other embodiments, another mechanism can be selectively used. For example, the drivable member 23*a* can be driven by a handle, or the drivable member 23*a* is driven to enter or leave the resonant chamber C by a piston-like structure, as long as the volume of the resonant chamber C can be increased or decreased by the design of the mechanism.

In this embodiment, the combination of the drivable member 23*a* and the rotation member 23*b* can be called an adjustment unit. Therefore, by the adjustment unit adjusting the volume of the resonant chamber C, the audio frequency characteristic of the earphone device 2 can be selectively made approximate to the open-type earphone or the closed-type earphone. When the adjustment unit decreases the volume of the resonant chamber C, the earphone device 2 will be better at the performance of the middle-high audio frequency so as to improve the effect and stay normal for the portion of low frequency. Accordingly, the portion of the middle frequency output will be more outstanding, so that the audio frequency characteristic of the earphone device 2 more approximates to the open-type earphone. On the other hand, when the adjustment unit increases the volume of the resonant chamber C, the low frequency output of the earphone device 2 will become more steady and thick and solid and stay normal for middle-high frequency. Accordingly, the audio frequency characteristic of the earphone device 2 more approximates to the closed-type earphone.

In other embodiments, an electronic circuit with a signal processing method also can be used to make the audio frequency characteristic of the earphone device approximate to the effect of the open-type earphone or the closed-type earphone. An audio frequency processing chip can be disposed on the source end of the audio frequency signal of the earphone device or within the earphone device to conduct the processing of the audio frequency signal. For example, a signal processing can be conducted for the audio effect output of the middle-high frequency or the low frequency. For example, when the audio performance of the middle-high frequency is optimized, the portion of the low frequency is not optimized, so that the portion of the middle-high frequency output is made better and the audio frequency characteristic of the earphone device 2 more approximates to the audio frequency characteristic of the open-type earphone. On the contrary, when the audio performance of the low frequency is optimized, the portion of the middle-high frequency can be not optimized, so that the portion of the low frequency output is made better and the audio frequency characteristic of the earphone device 2 more approximates to the audio frequency characteristic of the closed-type earphone.

Figure 3A:
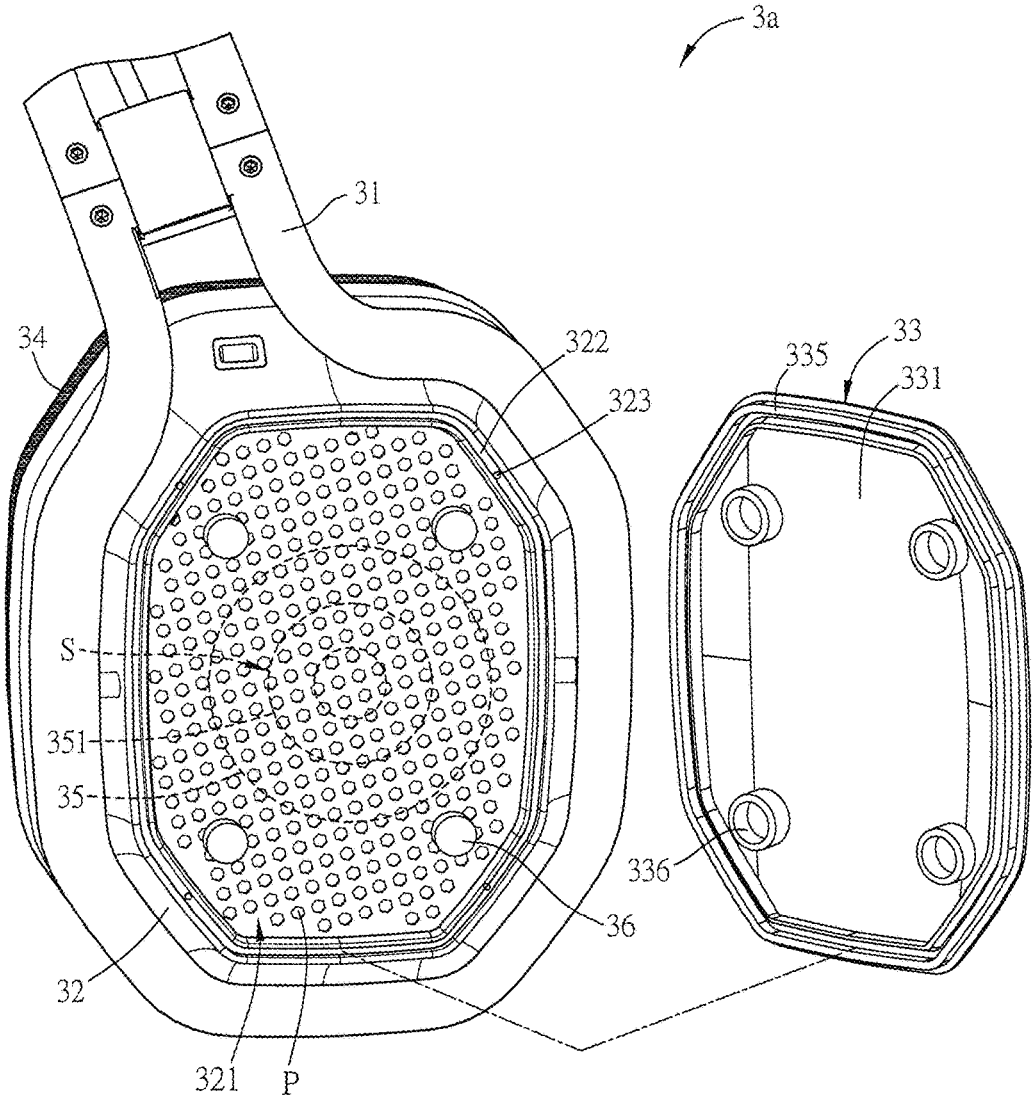
FIG. 3A is a schematic diagram of an earphone device of an embodiment of the invention.
Figure 3B:
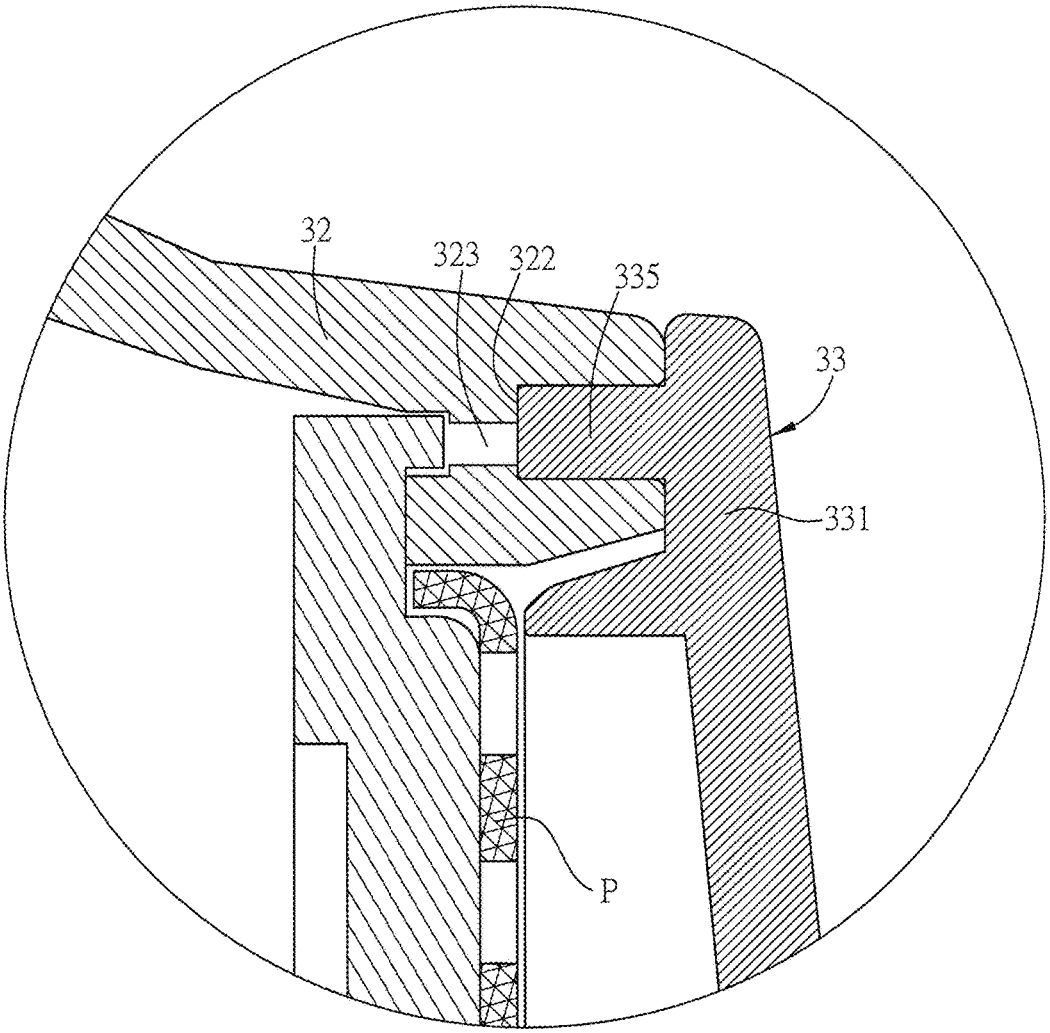
FIG. 3B is a schematic sectional diagram of the portion related to the through hole in FIG. 3A.

Please refer to FIGS. 3A and 3B, wherein FIG. 3A is a schematic diagram of an earphone device 3*a* of an embodiment of the invention and FIG. 3B is a schematic sectional diagram of the portion related to a through hole in FIG. 3A. The earphone device 3*a* includes a head band 31, two casings 32, a switching unit 33, two ear pads 34 and two earphone bodies 35. Each of two sides of the head band 31 is connected with a casing 32, and each of he casings 32 is connected with an ear pad 34. The casing 32 includes an opening 321 and an accommodating space S, and the earphone body 35 is disposed within the accommodating space S. The earphone body 35 includes a resonant film 351. The opening 321 can be configured with a protection structure P for protecting the earphone body 35 disposed in the accommodating space S from being exposed to the outside and thus from being damaged. The switching unit 33 includes a cover 331 to cover the opening 321. The embodiments with the variations of these components can be comprehended by referring to the corresponding components of the above-mentioned embodiments.

A groove 322 is disposed at the periphery of the casing 32, and a plurality of through holes 323 are disposed on the groove 322. The number of the through holes 323 is, for example but not limited to, four. The aperture of the through hole 323 is about 1 mm to 3 mm. The through hole 323 can make the air of the inside and the outside of the earphone body 35 communicate with each other. The size and the number of the through hole 323 will also affect the audio frequency characteristic of the earphone device 3*a*.

The switching unit 33 is assembled with the casing 32 and includes a protruding bar 335 and a plurality of fixing portions 336. The protruding bar 335 and the fixing portions 336 are disposed on the cover 331. When the opening 321 is sealed, the positioning pillars 36 disposed adjacent to the earphone body 35 is inserted into the fixing portion 336 and the protruding bar 335 is embedded into the groove 322, so that the switching unit 33 also seals the through hole 323 in addition to covering the earphone body 35. The protruding bar 335 or the groove 322 can function as a sealing member, which can be made of, for example, sponge, rubber or soft buffering material, whereby the cover 331 of the switching unit 33 can securely and completely seal the opening 321. By the switching unit 33 capable of selectively sealing or exposing the opening 321 of the casing 32, the earphone device 3*a* can be selectively switched to the open-type or the closed-type earphone device. Moreover, because the casing 32 is further configured with a plurality of through holes 323, the earphone device 3*a* can much more show the audio frequency characteristic of the open-type earphone when the opening 321 and the through hole 323 are exposed. On the other hand, when the opening 321 and the through hole 323 are sealed, the earphone device 3*a* can much more show the audio frequency characteristic of the closed-type earphone.

Figure 3C:
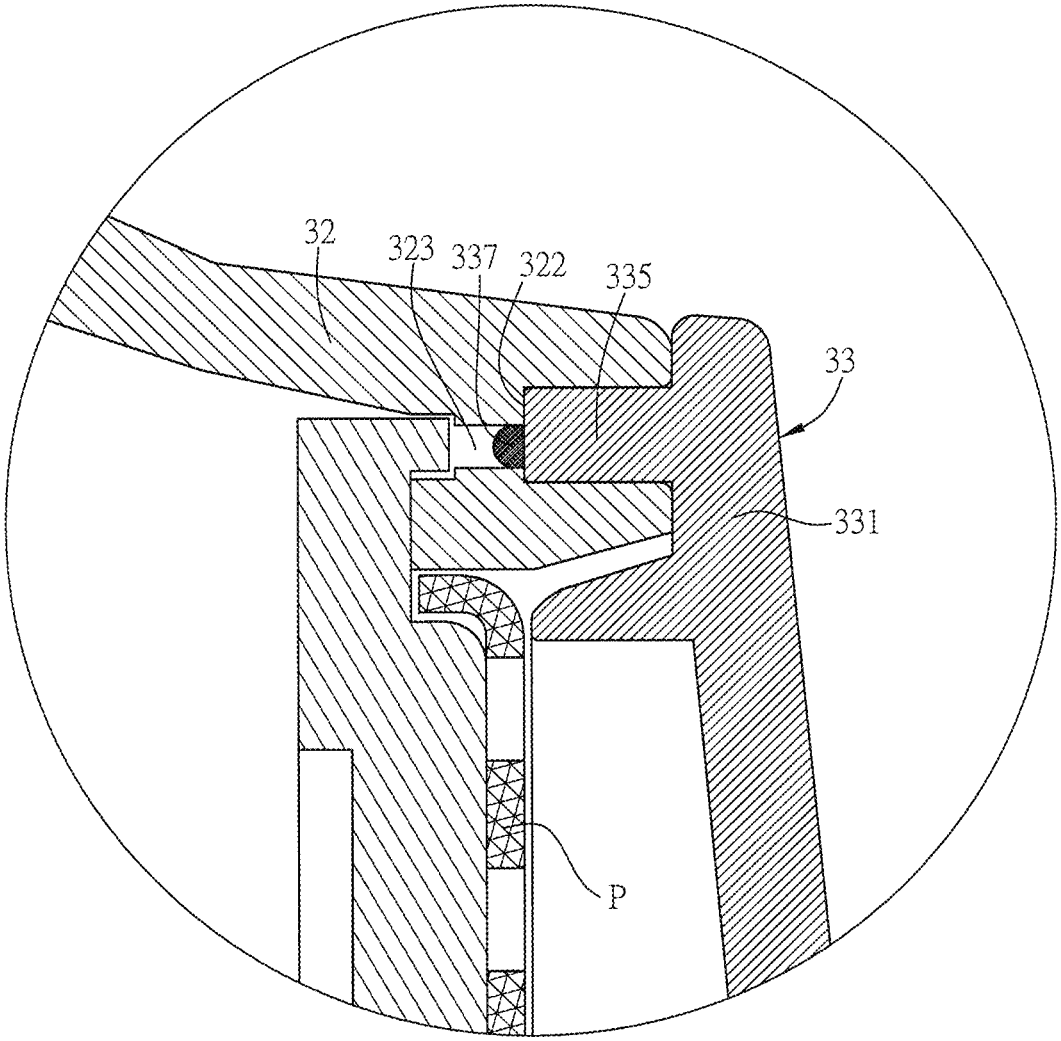
FIG. 3C is a schematic diagram of a variation of FIG. 3B.

Pleaser refer to FIG. 3C, which is a schematic diagram of a variation of FIG. 3B. In this embodiment, the protruding bar 335 of the switching unit 33 is further configured with a protruding pillar 337, which is inserted into the through hole 323 to seal the through hole 323 more tightly. For example, the material of the protruding pillar 337 can be sponge, rubber or soft buffering material. The protruding pillar 337 and the through hole 323 are tightly matched with each other.

Figure 4A:
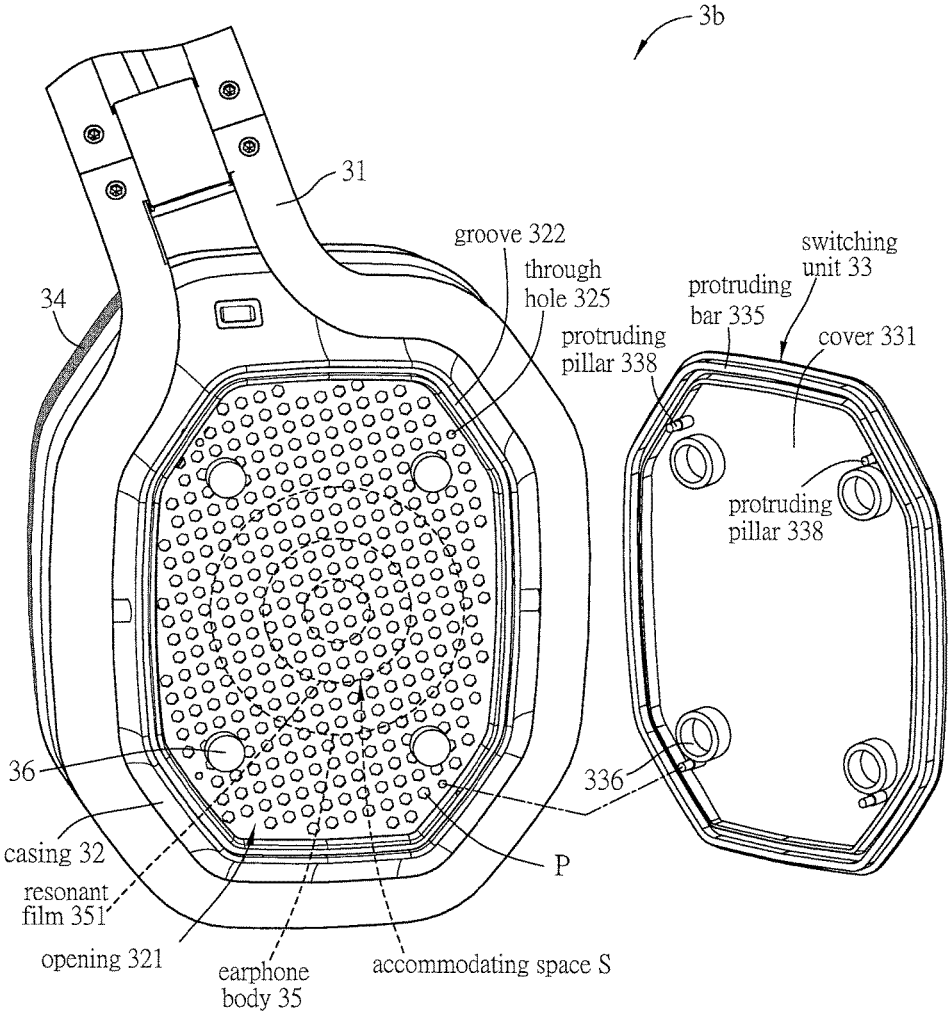
FIG. 4A is a schematic diagram of an earphone device of an embodiment of the invention.
Figure 4B:
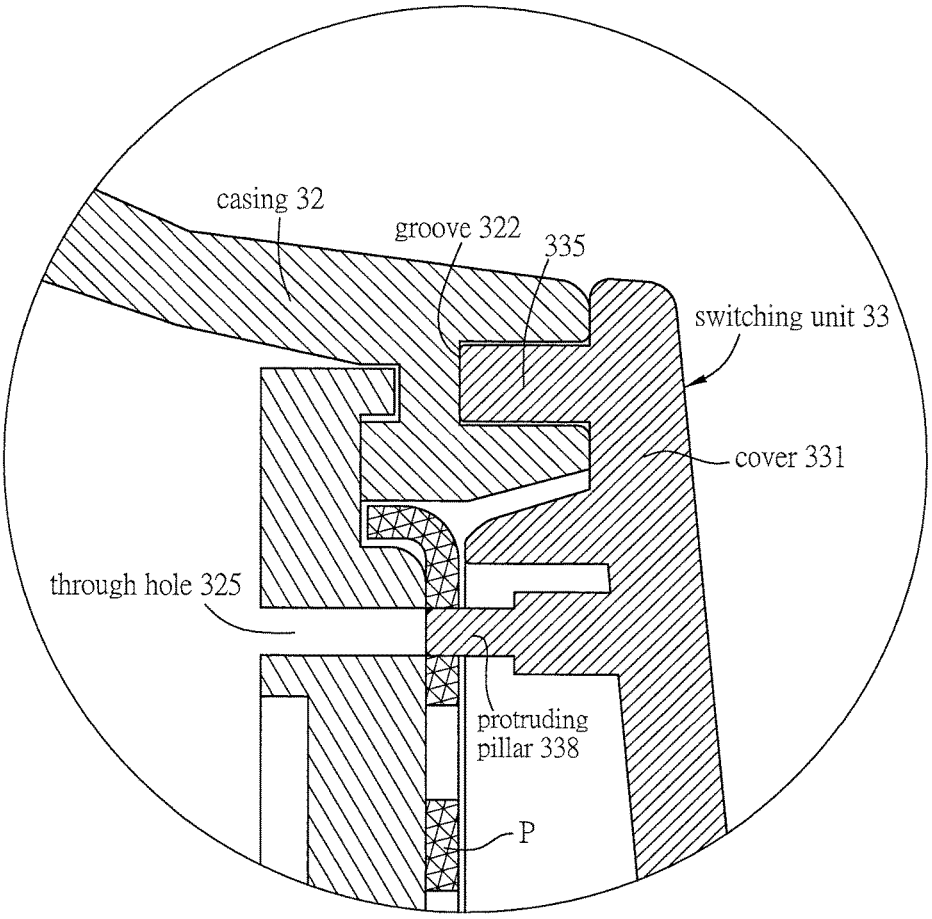
FIG. 4B is a schematic sectional diagram of the portion related to the through hole in FIG. 4A.

Pleaser refer to FIGS. 4A and 4B, wherein FIG. 4A is a schematic diagram of an earphone device 3*b* of an embodiment of the invention and FIG. 4B is a schematic sectional diagram of the portion related to a through hole in FIG. 4A. The main difference from FIG. 3A is in that a plurality of through holes 325 are disposed outside the earphone body 35. In this embodiment, the number of the through holes is, for example but not limited to, four. When the opening 321 is sealed, the protruding bar 335 is embedded into the groove 322 and the protruding pillar 338 of the switching unit 33 seals the through hole 325, so that the switching unit 33 also seals the through hole 325 in addition to covering the earphone body 35. In FIG. 4B, the protruding pillar 338 is disposed on the cover 331 and passes through a hole of the protection structure P and seals the through hole 325.

Figure 4C:
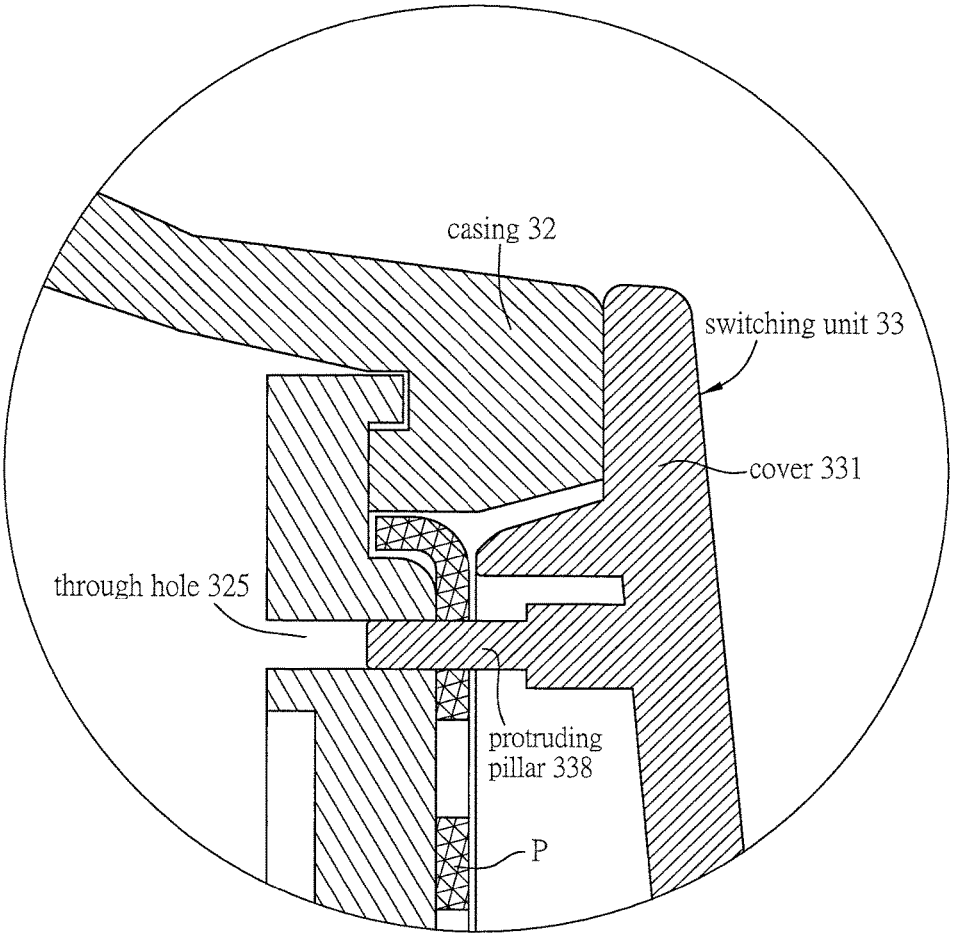
FIG. 4C is a schematic diagram of a variation of FIG. 4B.

Pleaser refer to FIG. 4C, which is a schematic diagram of a variation of FIG. 4B. In this embodiment, the protruding pillar 338 is further inserted into the through hole 325 to seal the through hole 325 more tightly. For example, the material of the protruding pillar 338 can be sponge, rubber or soft buffering material. The protruding pillar 338 and the through hole 325 are matched with each other tightly. In this embodiment, the switching unit 33 is not configured with the protruding bar 335 and the casing 32 is not configured with the groove 322.

Summarily, in an earphone device of the invention, by the switching unit capable of selectively sealing or exposing the opening, the earphone device can be correspondingly switched to the open-type earphone device or the closed-type earphone device. Or, by the adjustment unit adjusting the volume of the resonant chamber, the audio frequency characteristic of the earphone device can be selectively made approximate to the open-type earphone device or the closed-type earphone device. Or, by the rotation member rotating to drive the drivable member to adjust the volume of the resonant chamber, the audio frequency characteristic of the earphone device can be selectively made approximate to the open-type earphone device or the closed-type earphone device. Therefore, in comparison with a single type of earphone device of the prior art, the earphone device of the invention can possess the both advantages of the open-type and the closed-type earphone devices so that the user can have different hearing experiences when listening to different types of music.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An earphone device, comprising:

a casing including an opening and an accommodating space, the opening communicating with the accommodating space and an outside of the casing, wherein a groove is disposed at a periphery of the casing, and wherein the casing further includes at least one positioning pillar located in the opening;

an earphone body disposed in the accommodating space, wherein a plurality of through holes are disposed outside the earphone body; and a detachable cover having a protruding bar along a periphery of the detachable cover, wherein the detachable cover includes at least one fixing portion;

wherein the detachable cover and the casing are combined together, the protruding bar is embedded into the groove, and the at least one positioning pillar is inserted into the at least one fixing portion such that the detachable cover covers the earphone body and the through holes, wherein the through holes are disposed outside the earphone body to make an inside and an outside of the earphone body communicate with each other, and the detachable cover includes a plurality of protruding pillars respectively sealing the through holes.

2. The earphone device recited in claim 1, wherein the earphone body includes a resonant film, which faces the opening.

3. The earphone device recited in claim 1, wherein the detachable cover can selectively seal or expose the opening to correspondingly switch the earphone device to an open-type earphone device or a closed-type earphone device, when the detachable cover and the casing are combined together and the protruding bar is embedded into the groove, the detachable cover covers the earphone body and the through holes, and the earphone device is switched to the closed-type earphone device.

4. The earphone device recited in claim 1, further comprising a protection structure located in the opening for protecting the earphone body, wherein the protection structure has a plurality of holes.

5. The earphone device recited in claim 1, wherein the detachable cover is non-rotatably combined to the casing.

* * * * *